US011339461B2

(12) United States Patent
Hirata et al.

(10) Patent No.: US 11,339,461 B2
(45) Date of Patent: May 24, 2022

(54) AUSTENITIC STAINLESS STEEL

(71) Applicant: NIPPON STEEL CORPORATION, Tokyo (JP)

(72) Inventors: Hiroyuki Hirata, Tokyo (JP); Katsuki Tanaka, Tokyo (JP); Kana Jotoku, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/753,212

(22) PCT Filed: Oct. 3, 2018

(86) PCT No.: PCT/JP2018/037095
§ 371 (c)(1),
(2) Date: Apr. 2, 2020

(87) PCT Pub. No.: WO2019/069998
PCT Pub. Date: Apr. 11, 2019

(65) Prior Publication Data

US 2020/0318225 A1 Oct. 8, 2020

(30) Foreign Application Priority Data

Oct. 3, 2017 (JP) ..... JP2017-193687

(51) Int. Cl.
*C22C 38/42* (2006.01)
*C22C 38/00* (2006.01)
(Continued)

(52) U.S. Cl.
CPC ..... *C22C 38/42* (2013.01); *C21D 8/005* (2013.01); *C22C 38/001* (2013.01);
(Continued)

(58) Field of Classification Search
CPC ..... C22C 38/42; C22C 38/001; C22C 38/002; C22C 38/005; C22C 38/008; C22C 38/02;
(Continued)

(56) References Cited

U.S. PATENT DOCUMENTS

2010/0034689 A1 2/2010 Hirata et al.
2010/0054983 A1 3/2010 Osuki et al.
(Continued)

FOREIGN PATENT DOCUMENTS

CN 102317489 A 1/2012
CN 102510909 A 6/2012
(Continued)

OTHER PUBLICATIONS

DeLong et al. "Failure Analysis and Metallurgical Evaluation of Turbine Stop and Control Valves Used at Super High Temperature and Pressure Plant", The Thermal and Nuclear Power, Nov. 1984, vol. 35, No. 11. pp. 1249-1269, with partial english translation.
(Continued)

*Primary Examiner* — Humera N. Sheikh
*Assistant Examiner* — Katherine A Christy
(74) *Attorney, Agent, or Firm* — Birch, Stewart, Kolasch & Birch, LLP.

(57) ABSTRACT

A austenitic stainless steel which has a chemical composition consisting of, by mass %, C: 0.04 to 0.12%, Si: 0.25 to 0.55%, Mn: 0.7 to 2.0%, P: 0.035% or less, S: 0.0015% or less, Cu: 0.02 to 0.80%, Co: 0.02 to 0.80%, Ni: 10.0 to 14.0%, Cr: 15.5 to 17.5%, Mo: 1.5 to 2.5%, N: 0.01 to 0.10%, Al: 0.030% or less, O: 0.020% or less, Sn: 0 to 0.01%, Sb: 0 to 0.01%, As: 0 to 0.01%, Bi: 0 to 0.01%, V: 0 to 0.10%, Nb: 0 to 0.10%, Ti: 0 to 0.10%, W: 0 to 0.50%, B: 0 to 0.005%, Ca: 0 to 0.010%, Mg: 0 to 0.010% and REM: 0 to 0.10%, with the balance being Fe and impurities,
(Continued)

and satisfying [18.0≤Cr+Mo+1.5×Si≤20.0] and [14.5≤Ni+30×(C+N)+0.5×(Mn+Cu+Co)≤19.5].

3 Claims, 1 Drawing Sheet

(51) Int. Cl.

| | |
|---|---|
| ***C22C 38/02*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/58*** | (2006.01) |
| ***C21D 8/00*** | (2006.01) |
| ***C22C 38/06*** | (2006.01) |

(52) U.S. Cl.
CPC ..... *C22C 38/002* (2013.01); *C22C 38/005* (2013.01); *C22C 38/008* (2013.01); *C22C 38/02* (2013.01); *C22C 38/06* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C21D 2211/001* (2013.01)

(58) Field of Classification Search
CPC ..... C22C 38/44; C22C 38/46; C22C 38/48; C22C 38/50; C22C 38/52; C22C 38/54; C22C 38/58; C21D 2211/001
USPC ..... 420/49
See application file for complete search history.

(56) References Cited

U.S. PATENT DOCUMENTS

| | | | | |
|---|---|---|---|---|
| 2013/0130058 | A1 | 5/2013 | Iseda et al. | |
| 2014/0356641 | A1* | 12/2014 | Miyamura ..... | C22C 38/04 428/544 |

FOREIGN PATENT DOCUMENTS

| | | | |
|---|---|---|---|
| CN | 106756610 | A | 5/2017 |
| DE | 102015200881 | A1 | 7/2016 |
| JP | 57-2869 | A | 1/1982 |
| JP | 61-23749 | A | 2/1988 |
| JP | 2017-95767 | A | 6/2017 |
| WO | WO 2009/044796 | A1 | 4/2009 |

OTHER PUBLICATIONS

International Preliminary Report on Patentability, dated Apr. 16, 2020, and Written Opinion of the International Searching Authority(Forms PCT/IB/326, PCT/IB/373 and PCT/ISA/237), dated Dec. 25, 2018, for International Application No. PCT/JP2018/037095, with an English Translation.

International Search Report (PCT/ISA/210), dated Dec. 25, 2018, for International Application No. PCT/JP2018/037095, with an English translation.

McGough et al., "Selection and Fabrication of Replacement Main Steam Piping for thee Eddystone No. 1 Supercritical Pressure Unit", Welding Journal, Jan. 1985. pp. 29-36 (8 pages).

* cited by examiner

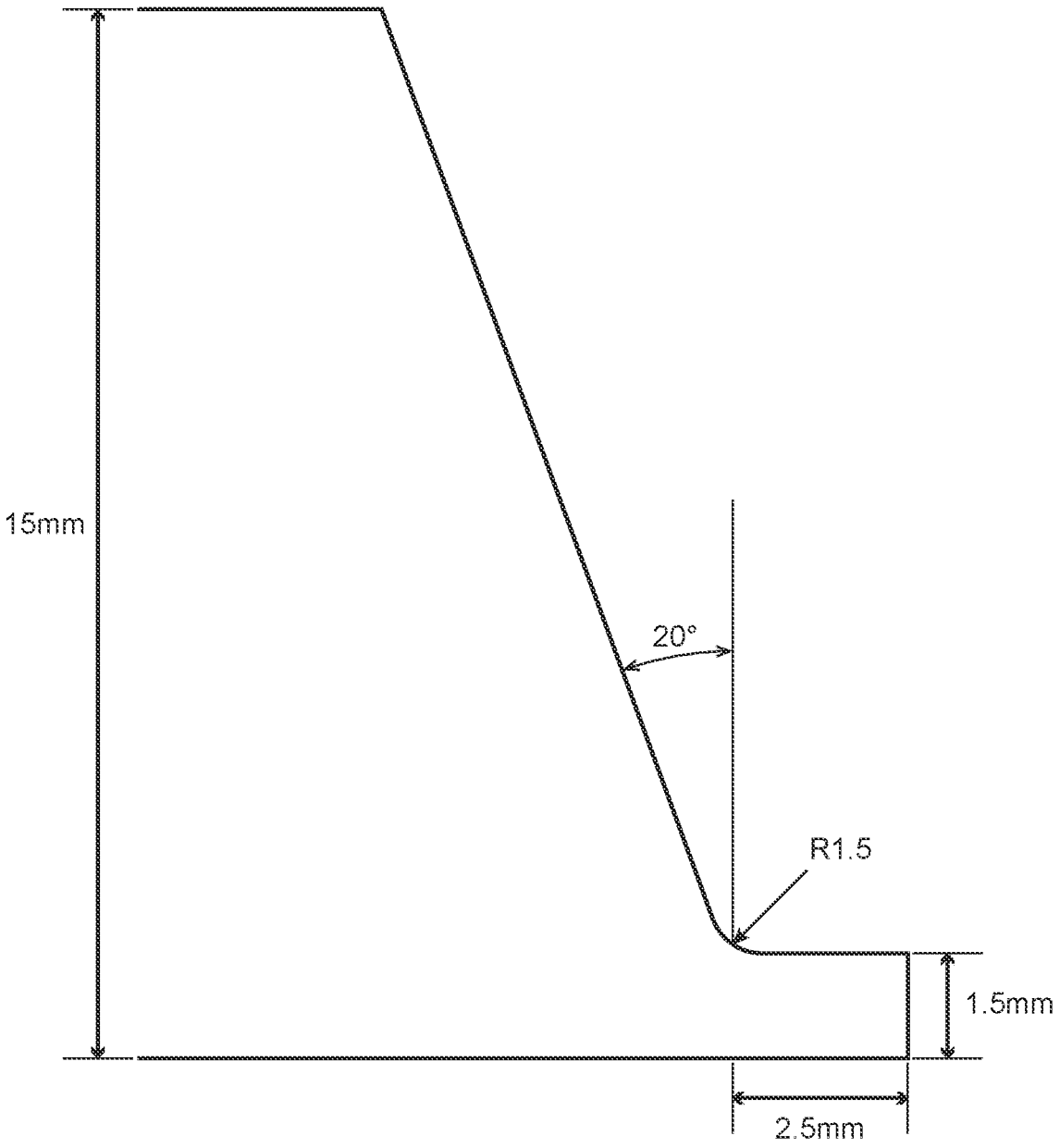
15mm
20°
R1.5
1.5mm
2.5mm

AUSTENITIC STAINLESS STEEL

TECHNICAL FIELD

The present invention relates to an austenitic stainless steel.

BACKGROUND ART

TP316H that is defined by ASME (American Society of Mechanical Engineers) SA213 and SA213M contains Mo and is excellent in corrosion resistance at high temperatures, and is therefore widely used as a material for heat-transfer pipes and heat exchangers in thermal power generation plants and petrochemical plants.

For example, Patent Document 1 discloses a proposition of an austenitic stainless steel, which, similarly to TP316H, contains Mo, and also contains Ce to enhance high-temperature corrosion resistance. Further, Patent Document 2 discloses a proposition of an austenitic stainless steel and the like, which also contains Nb, Ta and Ti to enhance high temperature strength.

In this connection, as disclosed in Non-Patent Documents 1 and 2, it is widely known that TP31611 containing Mo, when used for a thick-walled structural member at a high temperature, causes creep damage that is attributable to a-phase precipitation. For example, Non-Patent Document 2 proposes suppressing a-phase precipitation by increasing the Ni balance and lowering an Nv-Nc value.

LIST OF PRIOR ART DOCUMENTS

Patent Documents

Patent Document 1: JP57-2869A
Patent Document 2: JP61-23749A

Non-Patent Documents

Non-Patent Document 1: T. C. McGough et al., Welding Journal, January (1985), p. 29
Non-Patent Document 2: John F DeLong et al., The Thermal and Nuclear Power, Vol. 35, No. 11, (1984), p. 1249

SUMMARY OF INVENTION

Technical Problem

However, in a case where the degree of stability of the austenite phase is increased by adopting the measures described in Non-Patent Document 2, cracking is liable to occur in a weld heat-affected zone. In particular, it has been found that in the case of a welded joint shape under strong constraints, such as when used for a thick-walled welded structure such as an actual large scale plant, in some cases cracking in weld heat-affected zones cannot be prevented. Therefore, there is a need to suppress the occurrence of cracking that occurs when performing welding and realize excellent weldability.

Further, on the other hand, even in a case where excellent weldability is achieved, the creep strength may in some cases deteriorate when made into a welded structure. Therefore, there is a need to realize stable creep strength as a structure in addition to weldability.

An objective of the present invention is to provide an austenitic stainless steel that can achieve both excellent weldability when subjected to welding, and stable creep strength as a structure.

Solution to Problem

The present invention has been made to solve the problems described above, and the gist of the present invention is the following austenitic stainless steel.

(1) An austenitic stainless steel having a chemical composition consisting of, by mass %:

C: 0.04 to 0.12%,
Si: 0.25 to 0.55%,
Mn: 0.7 to 2.0%,
P: 0.035% or less,
S: 0.0015% or less,
Cu: 0.02 to 0.80%,
Co: 0.02 to 0.80%,
Ni: 10.0 to 14.0%,
Cr: 15.5 to 17.5%,
Mo: 1.5 to 2.5%,
N: 0.01 to 0.10%,
Al: 0.030% or less,
O: 0.020% or less,
Sn: 0 to 0.01%,
Sb: 0 to 0.01%,
As: 0 to 0.01%,
Bi: 0 to 0.01%,
V: 0 to 0.10%,
Nb: 0 to 0.10%,
Ti: 0 to 0.10%,
W: 0 to 0.50%,
B: 0 to 0.005%,
Ca: 0 to 0.010%,
Mg: 0 to 0.010%,
REM: 0 to 0.10%, and
the balance: Fe and impurities,
and satisfying formula (i) and formula (ii) below:

$$18.0 \leq Cr+Mo+1.5\times Si \leq 20.0 \quad \text{(i)}$$

$$14.5 \leq Ni+30\times(C+N)+0.5\times(Mn+Cu+Co) \leq 19.5 \quad \text{(ii)}$$

where, each symbol of an element in the above formulas represents a content (mass %) of the corresponding element contained in the steel.

(2) The austenitic stainless steel according to (1) above, wherein:

the chemical composition contains, by mass %, one or more types of element selected from Sn, Sb, As and Bi in a total amount within a range of more than 0% to not more than 0.01%.

(3) The austenitic stainless steel according to (1) or (2) above, wherein the chemical composition contains, by mass %, one or more types of element selected from:

V: 0.01 to 0.10%,
Nb: 0.01 to 0.10%,
Ti: 0.01 to 0.10%,
W: 0.01 to 0.50%,
B: 0.0002 to 0.005%,
Ca: 0.0005 to 0.010%,
Mg: 0.0005 to 0.010%, and
REM: 0.0005 to 0.10%.

Advantageous Effects of Invention

According to the present invention, an austenitic stainless steel can be obtained that can achieve both excellent weldability when subjected to welding, and stable creep strength as a structure.

BRIEF DESCRIPTION OF DRAWING

FIG. 1 is a schematic cross-sectional view illustrating the shape of a test material which was subjected to beveling in the Examples.

DESCRIPTION OF EMBODIMENTS

The present inventors conducted detailed studies for achieving both excellent weldability when subjected to welding, and stable creep strength as a structure. As a result, the present inventors obtained the following findings.

As the result of conducting studies regarding cracking that occurred in welded joints when using thick-walled austenitic stainless steel, the present inventors discovered that: (a) cracking occurs at grain boundaries adjacent to fusion boundaries and at grain boundaries that are slightly away from fusion boundaries; (b) with regard to the former, fusion traces are observed at grain boundaries, and the cracking is liable to occur in component systems in which the stability of the austenite phase is high; (c) with regard to the latter, fusion traces are not observed at grain boundaries, and the cracking is liable to occur as the content of S increases.

Therefore, it is considered that the former is so-called "liquation cracking", resulting from the increase in the stability of the austenite phase, which makes it easy for P and S to undergo grain-boundary segregation in a thermal cycle during welding. Consequently, the melting point in the vicinity of grain boundaries decreases, the grain boundaries melt, and the locations in question open as cracking due to thermal stress. It is also considered that the latter is so-called "ductility-dip cracking", and is cracking that occurs when S that underwent grain-boundary segregation in a thermal cycle during welding causes the sticking force at the grain boundaries to decrease, and thermal stress exceeds the sticking force, causing the relevant portions to open.

Further, as the result of intensive studies, the present inventors ascertained that, in thick-walled austenitic stainless steel having a composition that is the object of the present invention, in order to consistently prevent cracking in weld heat-affected zones it is necessary that the value of $Cr+Mo+1.5\times Si$ is not less than 18.0 and the value of $Ni+30\times(C+N)+0.5\times(Mn+Cu+Co)$ is not more than 19.5, and also the content of S is limited to not more than 0.0015%. In addition, the present inventors found that it is necessary to contain a prescribed amount or more of Cu and Co in order to sufficiently obtain an effect that reduces weld crack susceptibility.

In this connection, although cracking during welding can be prevented by adopting the above measures, it was found that in a case where the value of $Cr+Mo+1.5\times Si$ is more than 20.0 or a case where the value of $Ni+30\times(C+N)+0.5\times(Mn+Cu+Co)$ is less than 14.5, on the contrary the austenite phase becomes unstable and a 6 phase forms during use at a high temperature and the creep strength decreases significantly.

Further, although on one hand S has an adverse effect on weld cracks, S increases the weld penetration depth when welding, and in particular has an effect of improving the weldability in fabrication during root pass welding. From the viewpoint of weld cracks, it was found that when the content of S is controlled to be 0.0015% or less, the weld penetration depth is not adequately obtained in some cases. Although, in order to solve this problem, it suffices to simply increase the weld heat input, increasing the heat input increases the hot cracking susceptibility when welding.

Therefore, the present inventors also discovered that when it is desired to adequately obtain this effect, it is effective to contain one or more types of element selected from Sn, Sb, As and Bi in an amount within a predetermined range. It is considered that this is because these elements influence the convection of the molten pool during welding and also evaporate from the molten pool surface to contribute to formation of a current path, and thereby promote melting in the depth direction.

The present invention was made based on the findings described above. The respective requirements of the present invention are described in detail hereunder.

(A) Chemical Composition

The reasons for limiting each element are as follows. Note that, the symbol "%" with respect to content in the following description means "mass percent".

C: 0.04 to 0.12%

C makes the austenite phase stable and also combines with Cr to form fine carbides, and improves the creep strength during use at high temperatures. However, if C is contained in excess, carbides precipitate in a large amount, which leads to sensitization of the weld zone. Therefore, the content of C is set within the range of 0.04 to 0.12%. The content of C is preferably 0.05% or more, and more preferably is 0.06% or more. Further, the content of C is preferably not more than 0.11%, and more preferably is not more than 0.10%.

Si: 0.25 to 0.55%

Si is an element that has a deoxidizing action, and is also required to secure corrosion resistance and oxidation resistance at high temperatures. However, if an excessive amount of Si is contained, the stability of the austenite phase will decrease, which will result in a decrease in the creep strength. Therefore, the content of Si is set within the range of 0.25 to 0.55%. The content of Si is preferably 0.28% or more, and more preferably is 0.30% or more. Further, the content of Si is preferably not more than 0.45%, and more preferably is not more than 0.40%.

Mn: 0.7 to 2.0%

Similarly to Si, Mn is an element that has a deoxidizing action. Mn also makes the austenite phase stable and contributes to improvement of the creep strength. However, if an excessive amount of Mn is contained, it will result in a decrease in creep ductility. Therefore, the content of Mn is set within the range of 0.7 to 2.0%. The content of Mn is preferably 0.8% or more, and more preferably is 0.9% or more. Further, the content of Mn is preferably not more than 1.9%, and more preferably is not more than 1.8%.

P: 0.035% or less

P is an element which is contained as an impurity, and segregates at crystal grain boundaries of weld heat-affected zones during welding and increases liquation cracking susceptibility. P also decreases the creep ductility. Therefore, an upper limit is set for the content of P, and is 0.035% or less. The content of P is preferably 0.032% or less, and more preferably is 0.030% or less. Note that, although it is preferable that the content of P is reduced as much as possible, that is, although the content may be 0%, extreme reduction of the content of P will lead to an increase in costs at the time of steel production. Therefore, the content of P is preferably 0.0005% or more, and more preferably is 0.0008% or more.

S: 0.0015% or less

Similarly to P, S is contained in the alloy as an impurity, and segregates at crystal grain boundaries of weld heat-affected zones during welding and increases liquation cracking susceptibility as well as ductility-dip cracking. Therefore, an upper limit is set for the content of S, and is 0.0015% or less. The content of S is preferably not more than 0.0012%, and more preferably is not more than 0.0010%. Note that although it is preferable that the content of S is reduced as much as possible, that is, the content may be 0%, while S is still an effective element for increasing the weld penetration depth during welding. Therefore, the content of S is preferably 0.0001% or more, and more preferably is 0.0002% or more.

Cu: 0.02 to 0.80%

Cu enhances the stability of the austenite phase and contributes to improving the creep strength. Further, the influence of imparting segregation energy of P and S and the like is small in comparison to Ni and Mn, and thus an effect of reducing grain-boundary segregation and decreasing weld crack susceptibility can be expected. However, if an excessive amount of Cu is contained, it will result in a decrease in hot workability. Therefore, the content of Cu is set within the range of 0.02 to 0.80%. The content of Cu is preferably 0.03% or more, and more preferably is 0.04% or more. Further, the content of Cu is preferably not more than 0.60%, and more preferably is not more than 0.40%.

Co: 0.02 to 0.80%

Co is an element that, similarly to Cu, enhances the stability of the austenite phase and contributes to improving the creep strength. Further, the influence of imparting segregation energy of P and S and the like is small in comparison to Ni and Mn, and thus an effect of reducing grain-boundary segregation and decreasing weld crack susceptibility can be expected. However, because Co is an expensive element, if an excessive amount of Co is contained, it will result in an increase in the cost. Therefore, the content of Co is set within the range of 0.02 to 0.80%. The content of Co is preferably 0.03% or more, and more preferably is 0.04% or more. Further, the content of Co is preferably not more than 0.75%, and more preferably is not more than 0.70%.

Ni: 10.0 to 14.0%

Ni is an essential element for ensuring the stability of the austenite phase during use for an extended period. However, Ni is an expensive element, and containing a large amount of Ni leads to an increase in the cost. Therefore, the content of Ni is set within the range of 10.0 to 14.0%. The content of Ni is preferably 10.2% or more, and more preferably is 10.5% or more. Further, the content of Ni is preferably not more than 13.8%, and more preferably is not more than 13.5%.

Cr: 15.5 to 17.5%

Cr is an essential element for ensuring oxidation resistance and corrosion resistance at a high temperature. Further, Cr also forms fine carbides and contributes to ensuring creep strength. However, containing a large amount of Cr will reduce the stability of the austenite phase, and on the contrary, will be detrimental to the creep strength. Therefore, the content of Cr is set within the range of 15.5 to 17.5%. The content of Cr is preferably 15.8% or more, and more preferably is 16.0% or more. Further, the content of Cr is preferably not more than 17.2%, and more preferably is not more than 17.0%.

Mo: 1.5 to 2.5%

Mo is an element which dissolves in the matrix and contributes to the enhancement of creep strength and tensile strength at high temperatures. In addition, Mo is effective for improving corrosion resistance. However, if the content of Mo is too large, it will decrease the stability of the austenite phase and will be detrimental to creep strength. In addition, because Mo is an expensive element, if the content of Mo is excessive, it will result in an increase in the cost. Therefore, the content of Mo is set within the range of 1.5 to 2.5%. The content of Mo is preferably 1.7% or more, and more preferably is 1.8% or more. Further, the content of Mo is preferably not more than 2.4%, and more preferably is not more than 2.2%.

N: 0.01 to 0.10%

N makes the austenite phase stable, and also dissolves or precipitates as nitrides and contributes to improving high temperature strength. However, if an excessive amount of N is contained, it will lead to a decrease in ductility. Therefore, the content of N is set within the range of 0.01 to 0.10%. The content of N is preferably 0.02% or more, and more preferably is 0.03% or more. Further, the content of N is preferably not more than 0.09%, and more preferably is not more than 0.08%.

Al: 0.030% or less

Al is added as a deoxidizer. However, if a large amount of Al is contained, the cleanliness of the steel will deteriorate and the hot workability will decrease. Therefore, the content of Al is set to 0.030% or less. The content of Al is preferably 0.025% or less, and more preferably is 0.020% or less. Note that, although it is not particularly necessary to set a lower limit for the content of Al, that is, although the content may be 0%, an extreme reduction will lead to an increase in the production cost of the steel. Therefore, the content of Al is preferably 0.0005% or more, and more preferably is 0.001% or more.

O: 0.020% or less

O (oxygen) is contained as an impurity. If the content of O is excessive, hot workability will decrease and it will also result in a deterioration in toughness and ductility. Therefore, the content of O is 0.020% or less. The content of O is preferably 0.018% or less, and more preferably is 0.015% or less. Note that, although it is not particularly necessary to set a lower limit for the content of O, that is, although the content may be 0%, an extreme reduction will lead to an increase in the production cost of the steel. Therefore, the content of O is preferably 0.0005% or more, and more preferably is 0.0008% or more.

As described above, Cr, Mo and Si exert an influence on the stability of the austenite phase. Therefore, it is necessary for the content of each of these elements to not only fall within the ranges described above, but also to satisfy formula (i) below. If the middle value in formula (i) is more than 20.0, the stability of the austenite phase will decrease, and during use at a high temperature a brittle σ phase will be formed and the creep strength will decrease. On the other hand, if the middle value in formula (i) is less than 18.0, although the stability of the austenite phase will increase, hot cracking is liable to occur during welding. The left-hand value in formula (i) is preferably 18.2, and more preferably is 18.5. On the other hand, the right-hand value in formula (i) is preferably 19.8, and more preferably is 19.5:

$$18.0 \leq Cr+Mo+1.5 \times Si \leq 20.0 \quad \text{(i)}$$

where, each symbol of an element in the above formula represents a content of (mass %) of the corresponding element that is contained in the steel.

Further, Ni, C, N, Mn, Cu and Co exert an influence on the stability of the austenite phase. Therefore, it is necessary for the content of each of these elements to not only fall within the ranges described above, but also to satisfy formula (ii) below. If the middle value in formula (ii) is less than 14.5, the stability of the austenite phase will not be sufficient, and during use at a high temperature a brittle σ phase will be formed and the creep strength will decrease. On the other hand, if the middle value in formula (ii) is more than 19.5, the austenite phase will become excessively stable, and hot cracking is liable to occur during welding. The left-hand value in formula (ii) is preferably 14.8, and more preferably 15.0. On the other hand, the right-hand value in formula (ii) is preferably 19.2, and more preferably 19.0:

$$14.5 \leq Ni+30\times(C+N)+0.5\times(Mn+Cu+Co) \leq 19.5 \quad \text{(ii)}$$

where, each symbol of an element in the above formulas represents a content (mass %) of the corresponding element that is contained in the steel.

In the chemical composition of the steel of the present invention, in addition to the elements described above, one or more types of element selected from Sn, Sb, As and Bi may also be contained within the ranges described below. The reason is described hereunder.

Sn: 0 to 0.01%

Sb: 0 to 0.01%

As: 0 to 0.01%

Bi: 0 to 0.01%

Sn, Sb, As and Bi exert an influence on convection of the molten pool during welding, and promote heat transport in the vertical direction of the molten pool, and have an effect of increasing the weld penetration depth by evaporating from the molten pool surface and forming a current path to increase the degree of concentration of the arc. Therefore, one or more types of element selected from these elements may be contained as necessary. However, if an excessive amount of these elements is contained, the cracking susceptibility at heat affected zones during welding will increase, and therefore the content of each of these elements is 0.01% or less. The content of each of these elements is preferably 0.008% or less, and more preferably 0.006% or less.

When it is desired to obtain the aforementioned effect, the content of one or more types of element selected from the aforementioned elements is preferably more than 0%, more preferably is 0.0005% or more, further preferably is 0.0008% or more, and still more preferably is 0.001% or more. Further, in the case of containing a combination of two or more types of element selected from the aforementioned elements, the total content of the elements is preferably 0.01% or less, more preferably is 0.008% or less, and further preferably is 0.006% or less.

In the chemical composition of the steel of the present invention, in addition to the elements described above, one or more types of element selected from V, Nb, Ti, W, B, Ca, Mg and REM may also be contained within the ranges described below. The reasons for limiting each element are described hereunder.

V: 0 to 0.10%

V combines with C and/or N to form fine carbides, nitrides or carbo-nitrides and contributes to the creep strength, and therefore may be contained as necessary. However, if contained in excess, a large amount of carbo-nitrides will precipitate and result in a reduction in the creep ductility. Therefore, the content of V is set to 0.10% or less. The content of V is preferably 0.09% or less, and more preferably is 0.08% or less. Note that, when it is desired to obtain the aforementioned effect, the content of V is preferably 0.01% or more, and more preferably is 0.02% or more.

Nb: 0 to 0.10%

Nb is an element that, similarly to V, combines with C and/or N and precipitates within grains as fine carbides, nitrides or carbo-nitrides and contributes to enhancing the creep strength and tensile strength at a high temperature, and therefore may be contained as necessary. However, if contained in excess, a large amount of carbo-nitrides will precipitate and result in a reduction in the creep ductility. Therefore, the content of Nb is set to 0.10% or less. The content of Nb is preferably 0.08% or less, and more preferably is 0.06% or less. Note that, when it is desired to obtain the aforementioned effect, the content of Nb is preferably 0.01% or more, and more preferably is 0.02% or more.

Ti: 0 to 0.10%

Ti is an element that, similarly to V and Nb, combines with C and/or N to form fine carbides, nitrides or carbo-nitrides and contributes to creep strength, and therefore may be contained as necessary. However, if contained in excess, a large amount of carbo-nitrides will precipitate and result in a reduction in the creep ductility. Therefore, the content of Ti is set to 0.10% or less. The content of Ti is preferably 0.08% or less, and more preferably is 0.06% or less. Note that, when it is desired to obtain the aforementioned effect, the content of Ti is preferably 0.01% or more, and more preferably 0.02% or more.

W: 0 to 0.50%

W is an element that, similarly to Mo, dissolves in the matrix and contributes to enhancement of creep strength and tensile strength at high temperatures, and therefore may be contained as necessary. However, if contained in excess, W will reduce the stability of the austenite phase and, on the contrary, will result in a decrease in the creep strength. Therefore, the content of W is set to 0.50% or less. The content of W is preferably 0.40% or less, and more preferably 0.30% or less. Note that, when it is desired to obtain the aforementioned effect, the content of W is preferably 0.01% or more, and more preferably 0.02% or more.

B: 0 to 0.005%

B causes grain boundary carbides to finely disperse to thereby enhance the creep strength, and also segregates at the grain boundaries to strengthen the grain boundaries and has a certain effect for reducing ductility-dip cracking susceptibility in weld heat-affected zones, and therefore may be contained as necessary. However, if contained in excess, conversely, B will increase liquation cracking susceptibility. Therefore, the content of B is set to 0.005% or less. The content of B is preferably 0.004% or less, more preferably is 0.003% or less, and further preferably is 0.002% or less. Note that, when it is desired to obtain the aforementioned effect, the content of B is preferably 0.0002% or more, and more preferably 0.0005% or more.

Ca: 0 to 0.010%

Ca has an effect that improves hot workability during production, and therefore may be contained as necessary. However, if contained in excess, Ca will combine with oxygen and cause the cleanliness to markedly decrease, and on the contrary will cause the hot workability to deteriorate. Therefore, the content of Ca is set to 0.010% or less. The content of Ca is preferably 0.008% or less, and more preferably is 0.005% or less. Note that, when it is desired to obtain the aforementioned effect, the content of Ca is preferably 0.0005% or more, and more preferably is 0.001% or more.

Mg: 0 to 0.010%

Similarly to Ca, Mg has an effect that improves hot workability during production, and therefore may be contained as necessary. However, if contained in excess, Mg will combine with oxygen and cause the cleanliness to markedly decrease, and on the contrary will cause the hot workability to deteriorate. Therefore, the content of Mg is set to 0.010% or less. The content of Mg is preferably 0.008% or less, and more preferably 0.005% or less. Note that, when it is desired to obtain the aforementioned effect, the content of Mg is preferably 0.0005% or more, and more preferably 0.001% or more.

REM: 0 to 0.10%

Similarly to Ca and Mg, REM has an effect that improves hot workability during production, and therefore may be contained as necessary. However, if contained in excess, REM will combine with oxygen and cause the cleanliness to markedly decrease, and on the contrary will cause the hot workability to deteriorate. Therefore, the content of REM is set to 0.10% or less. The content of REM is preferably 0.08% or less, and more preferably 0.06% or less. Note that, when it is desired to obtain the aforementioned effect, the content of REM is preferably 0.0005% or more, and more preferably 0.001% or more.

As used herein, the term "REM" refers to a total of 17 elements that are Sc, Y and the lanthanoids, and the aforementioned content of REM means the total content of these elements.

In the chemical composition of the steel of the present invention, the balance is Fe and impurities. As used herein, the term "impurities" refers to components which, during industrial production of the steel, are mixed in from raw material such as ore or scrap or due to various factors in the production process, and which are allowed within a range that does not adversely affect the present invention.

(B) Production Method

Although a method for producing the austenitic stainless steel according to the present invention is not particularly limited, for example, the austenitic stainless steel can be produced by subjecting steel having the chemical composition described above to hot forging, hot rolling, heat treatment and machining in that order according to a normal method.

Hereunder, the present invention is described specifically by way of examples, although the present invention is not limited to these examples.

Example

Test materials having a thickness of 15 mm, a width of 50 mm, and a length of 100 mm were prepared from ingots that were cast by melting steels having the chemical compositions shown in Table 1, by performing hot forging, hot rolling, heat treatment and machining. Various performance evaluation tests that are described below were conducted using the obtained test materials.

TABLE 1

| | Chemical Composition (mass %; balance; Fe and impurities) | | | | | | | | | | | | | | Formula (i)† | Formula (ii)‡ |
|---|---|---|---|---|---|---|---|---|---|---|---|---|---|---|---|---|
| Steel | C | St | Mn | P | S | Cu | Co | Ni | Cr | Mo | N | Al | O | Other | middle value | middle value |
| A | 0.07 | 0.35 | 1.56 | 0.019 | 0.0010 | 0.04 | 0.25 | 13.8 | 16.8 | 2.2 | 0.09 | 0.007 | 0.009 | — | 19.5 | 19.5 |
| B | 0.08 | 0.41 | 1.80 | 0.025 | 0.0015 | 0.25 | 0.02 | 13.5 | 16.0 | 1.8 | 0.07 | 0.013 | 0.008 | — | 18.4 | 19.0 |
| C | 0.07 | 0.43 | 0.90 | 0.028 | 0.0012 | 0.39 | 0.70 | 10.5 | 15.6 | 2.4 | 0.03 | 0.010 | 0.007 | — | 18.6 | 14.5 |
| D | 0.06 | 0.28 | 0.82 | 0.032 | 0.0002 | 0.03 | 0.04 | 12.8 | 16.0 | 1.7 | 0.05 | 0.007 | 0.003 | Ti: 0.06, Nb: 0.02, REM: 0.006 | 18.1 | 16.5 |
| E | 0.10 | 0.39 | 0.90 | 0.030 | 0.0004 | 0.11 | 0.48 | 11.9 | 16.5 | 2.0 | 0.08 | 0.004 | 0.008 | Bi: 0.001, W: 0.27, B: 0.0020, Mg: 0.001 | 19.1 | 18.0 |
| F | 0.08 | 0.37 | 1.48 | 0.022 | 0.0003 | 0.21 | 0.03 | 13.2 | 15.8 | 2.1 | 0.10 | 0.005 | 0.010 | Sn: 0.006, Sb: 0.001, As: 0.001, V: 0.08, Ca: 0.002 | 18.5 | 19.5 |
| G | 0.09 | 0.35 | 1.48 | 0.034 | 0.0020 | 0.20 | 0.24 | 13.5 | 16.6 | 1.6 | 0.04 | 0.008 | 0.006 | — | 18.7 | 18.4 |
| H | 0.11 | 0.26 | 1.78 | 0.029 | 0.0014 | 0.32 | 0.45 | 13.9 | 5.9 | 1.6 | 0.04 | 0.008 | 0.008 | — | 17.9 | 19.7 |
| I | 0.06 | 0.30 | 1.06 | 0.030 | 0.0002 | 0.04 | 0.04 | 10.4 | 17.0 | 2.3 | 0.05 | 0.006 | 0.009 | Sn: 0.005, Bi: 0.001, W: 0.28 | 19.8 | 14.3 |
| J | 0.07 | 0.40 | 0.94 | 0.027 | 0.0003 | 0.38 | 0.12 | 12.5 | 17.4 | 2.4 | 0.03 | 0.009 | 0.004 | V: 0.05 | 20.4 | 16.2 |
| K | 0.10 | 0.25 | 1.75 | 0.033 | 0.0012 | 0.48 | 0.44 | 13.6 | 15.7 | 1.6 | 0.05 | 0.008 | 0.007 | Ti: 0.03 | 17.7 | 19.4 |
| L | 0.11 | 0.35 | 1.85 | 0.032 | 0.0014 | 0.24 | 0.25 | 13.8 | 16.2 | 1.8 | 0.05 | 0.007 | 0.005 | Ca: 0.003 | 18.5 | 19.8 |
| M | 0.10 | 0.48 | 1.92 | 0.032 | 0.0013 | = | = | 13.5 | 15.8 | 2.0 | 0.04 | 0.010 | 0.006 | Sn: 0.009 | 18.5 | 18.7 |
| N | 0.09 | 0.50 | 1.90 | 0.034 | 0.0012 | = | 0.20 | 13.5 | 16.0 | 2.1 | 0.06 | 0.008 | 0.005 | B: 0.0042, Sn: 0.005, Bi: 0.003 | 18.9 | 19.1 |
| O | 0.11 | 0.47 | 1.88 | 0.030 | 0.0014 | 0.12 | = | 13.3 | 15.9 | 1.8 | 0.05 | 0.007 | 0.006 | B: 0.0045, Bt: 0.007, Sb: 0.003 | 18.4 | 19.1 |

†$18.0 \leq Cr + Mo + 1.5 \times Si \leq 20.0$ . . . (i)

‡$14.5 \leq Ni + 30 \times (C + N) + 0.5 \times (Mn + Cu + Co) \leq 19.5$ . . . (ii)

<Weldability in Fabrication>

A bevel having the shape shown in FIG. 1 was prepared at an end part in the longitudinal direction of the aforementioned test materials. Thereafter, two of the test materials with the bevel were butted together and butt welding was performed by TIG welding without using a filler material. Two welded joints were prepared for each test material, respectively, with a heat input of 8 kJ/cm. Among the obtained welded joints, those in which a root bead was formed across the entire length of the weld line in both welded joints were determined as having good weldability in fabrication, and were determined as "pass". Among these, welded joints in which the root bead width was 2 mm or more across the entire length were determined as being "good", and welded joints in which there was a portion in which the root bead width was less than 2 mm at even one part were determined as being "acceptable". Further, in a case where there was a portion in which a root bead was not formed at even one part among the two welded joints were determined as "fail".

<Weld Crack Resistance>

Thereafter, the periphery of the aforementioned welded joint which had undergone only root pass welding was subjected to restraint-welding onto a commercially available steel plate. Note that, the commercially available steel plate was a steel plate defined in JIS G 3160 (2008) of SM400B steel grade which had a thickness of 30 mm, a width of 200 mm and a length of 200 mm. Further, the restraint-welding was performed using a covered electrode ENi6625 defined in JIS Z 3224 (2010).

Thereafter, multi-pass welding was performed by TIG welding in the bevel. The multi-pass welding was performed using a filler material corresponding to SNi6625 defined in JIS Z 3334 (2011). The heat input was set in the range of 10 to 15 kJ/cm, and two welded joints were prepared for each of the test materials. Specimens for microstructural investigation were taken from five locations in one of the welded joints prepared from each test material. A transverse section of each of the obtained specimens was mirror-polished and then etched before being observed by optical microscopy to determine whether cracks were present in the weld heat-affected zones. A welded joint for which no cracks were observed in all of the five specimens was determined as "pass", and a welded joint in which cracks were observed was determined as "fail".

<Creep Rupture Strength>

In addition, a round-bar creep rupture test specimen was taken from the remaining one welded joint of the welded joints produced from test materials whose weld crack resistance was evaluated as "pass". The specimen was taken in a manner so that the weld metal was at the center of the parallel portion, and a creep rupture test was performed under conditions of 650° C. and 167 MPa in which the target rupture time of the base metal was approximately 1,000 hours. A welded joint in which rupturing occurred in the base metal and for which the rupture time was 90% or more of the target rupture time of the base metal was determined as "pass".

A summary of the results of these tests is shown in Table 2.

TABLE 2

| Test No. | Steel | Weldability in Fabrication | Weld Crack Resistance | Creep Rupture Strength |
|---|---|---|---|---|
| 1 | A | Pass (Good) | Pass | Pass |
| 2 | B | Pass (Good) | Pass | Pass |
| 3 | C | Pass (Good) | Pass | Pass |
| 4 | D | Pass (Acceptable) | Pass | Pass |
| 5 | E | Pass (Good) | Pass | Pass |
| 6 | F | Pass (Good) | Pass | Pass |
| 7 | G | Pass (Good) | Fail | Not performed |
| 8 | H | Pass (Good) | Fail | Not performed |
| 9 | I | Pass (Good) | Pass | Fail |
| 10 | J | Pass (Acceptable) | Pass | Fail |
| 11 | K | Pass (Good) | Fail | Not performed |
| 12 | L | Pass (Good) | Fail | Not performed |
| 13 | M | Pass (Good) | Fail | Not performed |
| 14 | N | Pass (Good) | Fail | Not performed |
| 15 | O | Pass (Good) | Fail | Not performed |

As will be understood from Table 2, the results showed that in Test Nos. 1 to 6 in which steels A to F that satisfied the requirements defined by the present invention were used, the test specimens had the required workability and weld crack resistance during production of the welded joints and were also excellent in creep strength. Further, as will be understood by comparing Test No. 4 with Test Nos. 5 and 6, in a case where S was reduced, an improvement in the weldability by containing one or more types of element selected from Sn, S, As and Bi was recognized.

In contrast, with respect to steel G as a Comparative Example, because the content of S was outside the range defined by the present invention, in Test No. 7 which used the steel G, cracking that was determined as being ductility-dip cracking occurred in the weld heat-affected zones. Further, steel H was below the lower limit of formula (i) and also more than the upper limit of formula (ii), and therefore in Test No. 8 in which the steel H was used, the stability of the austenite phase was excessively high, segregation of S and P was promoted by the welding thermal cycle, and cracking that was determined as being liquation cracking occurred in weld heat-affected zones.

Steel I was below the lower limit of formula (ii) and steel J exceeded the upper limit of formula (i), and therefore, because the stability of the austenite phase was insufficient, in Test Nos. 9 and 10 which used steel I and steel J, respectively, in the creep test at high temperature, a σ phase was formed and the required creep strength was not obtained. Further, steel K was below the lower limit of formula (i) and steel L exceeded the upper limit of formula (ii), and therefore in Test Nos. 11 and 12 which used steel K and steel L, respectively, the stability of the austenite phase was excessively high, segregation of S and P was promoted by the welding thermal cycle, and cracking that was determined as being liquation cracking occurred in weld heat-affected zones.

In addition, because steels M, N and O did not contain one of, or both of, Cu and Co, in Test Nos. 13 to 15 which used the steels M, N and O, respectively, an effect of reducing grain-boundary segregation of P and S was not obtained, and cracking that was determined as being liquation cracking occurred in the weld heat-affected zones.

As described above, it was found that the required weldability in fabrication and weld crack resistance as well as excellent creep strength were obtained only in a case where the requirements of the present invention were satisfied.

INDUSTRIAL APPLICABILITY

According to the present invention, an austenitic stainless steel can be obtained that can achieve both excellent weldability when subjected to welding, and stable creep strength as a structure.

The invention claimed is:

1. An austenitic stainless steel having a chemical composition consisting of, by mass %, C: 0.04 to 0.12%,
Si: 0.25 to 0.55%,
Mn: 0.7 to 2.0%,
P: 0.035% or less,
S: 0.0015% or less,
Cu: 0.02 to 0.80%,
Co: 0.02 to 0.80%,
Ni: 10.0 to 14.0%,
Cr: 15.5 to 17.5%,
Mo: 1.5 to 2.5%,
N: 0.01 to 0.10%,
Al: 0.030% or less,
O: 0.020% or less,
Sn: 0 to 0.01%,
Sb: 0 to 0.01%,
As: 0 to 0.01%,
Bi: 0 to 0.01%,
V: 0 to 0.05%,
Nb: 0 to 0.02%,
Ti: 0 to 0.01%,
W: 0 to 0.50%, B: 0 to 0.005%,
Ca: 0 to 0.010%,
Mg: 0 to 0.010%,
REM: 0 to 0.10%, and
the balance: Fe and impurities,
and satisfying formula (i) and formula below:

$$18.0 \leq Cr+Mo+1.5 \times Si \leq 20.0 \quad \text{(i)}$$

$$14.5 \leq Ni+30 \times (C+N)+0.5 \times (Mn+Cu+Co) \leq 19.5 \quad \text{(ii)}$$

where, each symbol of an element in the above formulas represents a content (mass %) of a corresponding element contained in the austenitic stainless steel.

2. The austenitic stainless steel according to claim 1, wherein the chemical composition contains, by mass %, one or more types of elements selected from Sn, Sb, As and Bi in a total amount within a range of more than 0% to not more than 0.01%.

3. The austenitic stainless steel according to claim 1, wherein the chemical composition contains, by mass %, one or more types of elements selected from:
V: 0.01 to 0.05%,
Nb: 0.01 to 0.02%,
Ti: 0.01 to 0.01%,
W: 0.01 to 0.50%,
B: 0.0002 to 0.005%,
Ca: 0,0005 to 0.010%,
Mg: 0.0005 to 0.010%, and
REM: 0.0005 to 0.10%.

* * * * *